United States Patent [19]

Park

[11] Patent Number: 4,526,403

[45] Date of Patent: Jul. 2, 1985

[54] COMBINED CALCULATOR TAPE AND COUPON AND METHOD OF USE

[76] Inventor: Robert W. Park, 1007 Forest La., Mt. Pleasant, Mich. 48858

[21] Appl. No.: 642,115

[22] Filed: Aug. 20, 1984

Related U.S. Application Data

[63] Continuation of Ser. No. 390,216, Jun. 21, 1982, abandoned.

[51] Int. Cl.[3] ..... B42D 15/00

[52] U.S. Cl. ..... 283/62; 235/7 A; 235/62 R; 281/5; 283/105

[58] Field of Search ..... 235/7 A, 62 R; 281/5; 283/56, 62, 90, 105, 114

[56] References Cited

U.S. PATENT DOCUMENTS 1,011,549 12/1911 Yantis ..... 235/7 A 3,042,426 7/1962 Cohen ..... 281/5 X

*Primary Examiner*—Paul A. Bell

*Attorney, Agent, or Firm*—Ian C. McLeod

[57] ABSTRACT

An improved method for using a calculator tape (12) in a roll (10) and redemption coupons (16) in combination is described. The method uses a novel tape roll (10) for a calculator or cash register (20), including a dried, moisture sensitive, adhesive (13) on one side of the tape which accepts printing from the calculator or cash register and including the coupons (16) provided on the other side (17) of the tape roll opposite the adhesive (13). The coupons can be pasted in a redemption booklet (23) by moistening the adhesive.

2 Claims, 5 Drawing Figures

COMBINED CALCULATOR TAPE AND COUPON AND METHOD OF USE

This application is a continuation of application Ser. No. 390,216, filed June 21, 1982 now abandoned.

BACKGROUND OF THE INVENTION (1) Field of the Invention

The present invention relates to a combined redemption coupon and calculator tape in a roll for use in a calculator or cash register. In particular, the present invention relates to roll of tape with an adhesive on one side which is used for printing of indicia for a monetary amount and with the coupons on the other side.

(2) Prior Art

U.S. Pat. No. 1,011,549 to Yantis describes a roll with perforated segments wherein randomly spaced segments on the roll have different colored coupons which are provided as prizes to purchasers to whom segments of the roll are presented as sales slips. U.S. Pat. No. 3,042,426 to Cohen shows a three part, longitudinally folded tape roll with a longitudinal line of perforations for separating the tape along a row of monetary indicia. The coupons are concealed inside the folds of the tape. The construction is relatively complex and expensive in comparison to conventional paper tape rolls.

The prior art has provided for redemption coupons as stamps with a moisture sensitive adhesive and booklets into which the moistened stamps are inserted. The coupons are a reward for a purchase based upon the amount of the purchase. The problem is that the coupons are separate from the tape segment bearing the individual item costs and totals for the purchaser.

(3) Objects

It is therefore an object of the present invention to provide a cash register tape and adhesively gummed coupons or stamps in combination in a single tape roll. The present invention further relates to a coupon tape roll which is simple and inexpensive to manufacture using conventional equipment for slitting paper and for rolling tape. These and other objects will become increasingly apparent by reference to the following description and the drawings.

IN THE DRAWINGS

GENERAL DESCRIPTION

The present invention relates to a method of providing individual and total of monetary amounts on a tape and redemption coupons using a calculator with a printer for the amounts and with a roll of tape fed to the printer which comprises providing a roll of tape in the calculator wherein the tape is provided with a dried, moisture sensitive adhesive on one side towards the printer and wherein the other side of the tape is provided with printed matter in the form of a redemption coupon; printing on the adhesive side of the roll the individual and total monetary amounts; removing a segment of the roll from the calculator including at least the printed portion; providing a coupon book with pages onto which the segments or portions thereof are pasted by moistening the adhesive; and providing for redemption of the coupons after a selected number have been collected.

The present invention further relates to a tape roll adapted for a printing calculator which comprises: an elongate strip of tape with a dried moisture sensitive adhesive on one side and redemption coupons printed on the other side, wherein the tape is in a roll with the adhesive exposed around the roll such that the calculator prints on the adhesive. The tape is preferably of paper.

Thus the present invention provides a means for combining adhesively backed coupons and cash register tape as a single combined unit. Unexpectedly, the adhesive accepts the printing of indicia without bleeding or other unwanted transfer of the printing inks. The inks can be of the conventional type. The adhesive can have a coloring agent in it, such as a whitening agent like titanium dioxide, in order to provide more contrast for the printing. The adhesive is preferably a dried, water soluble gum and must be flexible and strong enough to be fed through a calculator or cash register without gumming the printing mechanism or calculator.

SPECIFIC DESCRIPTION

Figure 1:
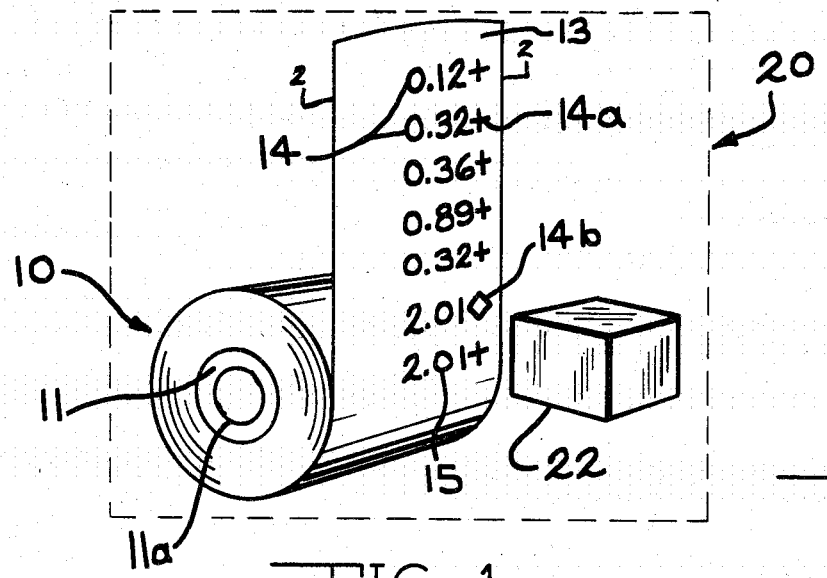
FIG. 1 is a front perspective view of a tape roll (10) in the setting of a cash register (20) shown in dotted lines, wherein the elongate strip of tape (12) is provided with a dried moisture sensitive adhesive (13) which has been printed with monetary indicia (14 and 15) by a printer (22) in the register.
Figure 2:
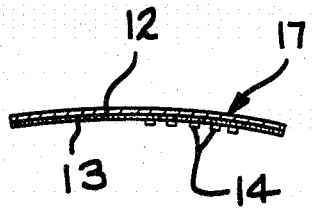
FIG. 2 is an end, cross-sectional view of the tape (12) with the adhesive (13) along line 2—2 of FIG. 1.
Figure 3:
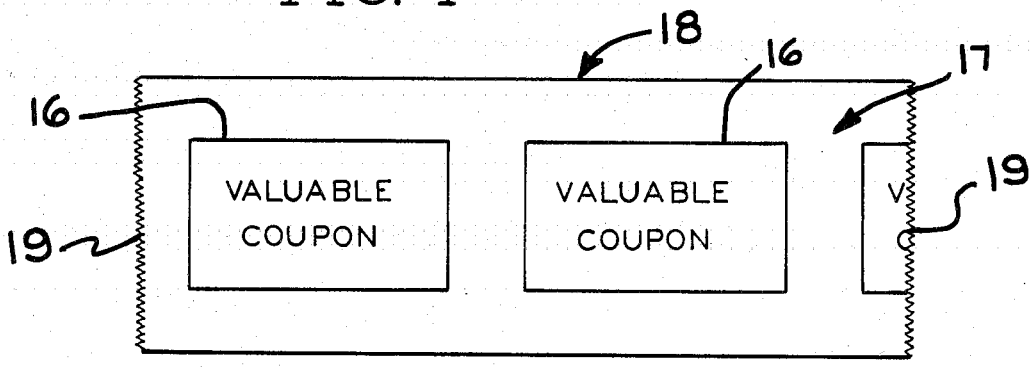
FIG. 3 is a plan view of a segment (18) of the tape (12) of FIG. 1 showing the coupons (16).
Figure 4:
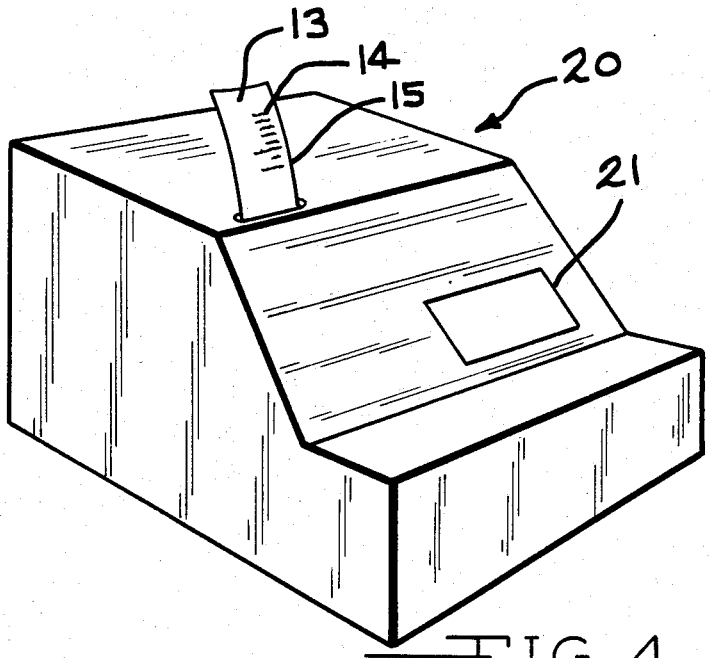
FIG. 4 is a front perspective view of a cash register (20) with the tape roll (10) in position for printing.
Figure 5:
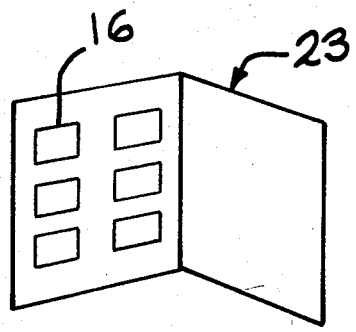
FIG. 5 is a front view of a redemption booklet (23) for the coupons (16).

Referring to FIGS. 1 to 4, the tape roll 10 of the present invention is shown. The roll 10 includes a conventional spool 11 with an opening 11*a*, which can be made of wood or plastic, and an elongate strip of tape 12, preferably made of paper but which can be made of plastic, wrapped around the spool 11. The strip 12 has a dried moisture sensitive adhesive 13 applied on the exposed side of the strip 12. The strip 12 with the adhesive 13 is formed by slitting a long, wide sheet of paper into the strips 11 (not shown). The adhesive 13 gives the strip 12 a slight curl 12*a* (FIG. 2). Individual item monetary indicia 14 and other indicia, such as the conventional calculator symbols "+" 14*a* and 14*b* for an intermediate total are provided along with the grand total monetary indicia 15. As can be seen from FIG. 2, the indicia 14 and 15 imprint directly into the adhesive 13.

The roll 10 of tape 12 is provided with coupons 16 printed on the other side 17 opposite the adhesive 13. The segment or slip 18 is separated with serrations 19 as either end from a serrated tear plate (not shown) in a cash register 20 after the total 15 has been found. The register 20 includes a conventional amount window 21 and internal printing heads 22 which are preferably of the type which prints solid indicia; however, the printing heads can be of the dot printer type (not shown).

The person who receives the slip 18 is preferably a purchaser, such as in a grocery store. The purchaser receives a coupon booklet 23 from the store and inserts the individual coupons 16 in the booklet 23 by cutting the coupons apart and moistening the adhesive 13. Periodically the purchaser presents the booklet 23 with the coupons 16 to the store for redemption, such as for food.

It will be recognized that the cash register 20 can be any sort of calculator. The segment or slip 18 can be used in any setting where it is desired to provide the user or a third party with coupons 16. The length of the segment or slip 18 determines the number of coupons 16 which the purchaser receives. Thus the greater the number of individual purchases reflected by the indicia 14, the greater the number of coupons 16. If desired for major purchases the tape can be rolled out of the register 20 without additional indicia 14 or 15. Also the individual coupons 16 can have perforations (not shown) between the coupons 16.

As can be seen the foregoing invention provides a simple means for providing pre-adhesively backed coupons and a cash register slip together. It saves using separate machines for dispensing stamps.

I claim:

1. A method of providing individual and total monetary amounts on a tape and redemption coupons together using a calculator with a printer for the amounts and with a roll of tape fed to the printer which comprises:

(a) providing a roll of tape in the calculator wherein the tape is provided with a dried, moisture sensitive printable adhesive on one side which is towards the printer and wherein the other side of the tape is provided with printed matter in the form of redemption coupons;

(b) printing on the adhesive side of the roll the individual and total monetary amounts using the printer;

(c) removing a segment of the roll from the calculator, said segment including at least a portion thereof which is printed on the adhesive side of the tape;

(d) providing a coupon book with pages onto which the segments or portions thereof are pasted by moistening the adhesive with the printing; and (e) providing for redemption of the coupon book after a selected number of segments or portions thereof have been collected and pasted in the book.

2. A method of providing individual and total monetary amounts on a tape and redemption coupons together using a calculator with a printer for the amounts and with a roll of tape fed to the printer which comprises:

(a) providing a roll of tape in the calculator wherein the tape is provided with a dried, moisture sensitive printable adhesive on one side which is towards the printer and wherein the other side of the tape is provided with printed matter in the form of redemption coupons;

(b) dispensing and printing on the adhesive side of the roll the individual and total monetary amounts using the printer; and (c) removing a segment of the roll from the calculator, said segment including at least a portion thereof which is printed on the adhesive side of the tape.

* * * * *